United States Patent [19]

Shafii-Rad-G.

[11] Patent Number: 4,505,044

[45] Date of Patent: Mar. 19, 1985

[54] DRAWING AID WITH INTERCHANGEABLE INSERT

[76] Inventor: Nader Shafii-Rad-G., P.O. Box 2284, Stanford, Calif. 94305

[21] Appl. No.: 531,578

[22] Filed: Sep. 12, 1983

Related U.S. Application Data

[63] Continuation of Ser. No. 301,656, Sep. 14, 1981, abandoned.

[51] Int. Cl.[3] ..... B43L 13/02

[52] U.S. Cl. ..... 33/174 B; 434/87

[58] Field of Search ..... 33/41 R, 41 B, 174 B, 33/174 G, 477; 434/87

[56] References Cited

U.S. PATENT DOCUMENTS

| | | | |
|---|---|---|---|
| 1,105,810 | 8/1914 | McAll | 33/174 B |
| 2,303,676 | 12/1942 | Bixby | 33/174 B |
| 2,444,860 | 7/1948 | Summer | 434/87 |
| 2,543,714 | 2/1951 | Bednarczuk | 33/174 B |
| 2,604,702 | 7/1952 | Collins | 33/174 B |
| 2,605,550 | 8/1952 | Campbell | 33/174 B |
| 2,909,843 | 10/1959 | Bechtel | 33/174 B |
| 3,584,385 | 6/1971 | Booth | 33/174 B |
| 3,665,612 | 5/1972 | Albright | 33/174 B |

FOREIGN PATENT DOCUMENTS

| | | | |
|---|---|---|---|
| 415071 | 6/1925 | Fed. Rep. of Germany | 33/174 B |
| 1288209 | 2/1962 | France | 33/174 B |
| 556681 | 2/1957 | Italy | 33/174 B |

OTHER PUBLICATIONS

Berol Rapi Design-Catalog, 1979, pp. 1-32.

*Primary Examiner*—Richard R. Stearns
*Attorney, Agent, or Firm*—Katharine Ku

[57] ABSTRACT

A drawing aid having a sandwich-like structure in which the middle layer is an interchangeable pattern insert. The insert is interchangeable with other inserts, each insert having a particular pattern. The interchangeability of the insert enables the drawing of different lines, shapes, letters, etc. using the same template housing. A particularly useful embodiment allows one to draw a line over the insert pattern, producing broken lines without lifting the drawing tool.

3 Claims, 5 Drawing Figures

DRAWING AID WITH INTERCHANGEABLE INSERT

This application is a continuation of application Ser. No. 301,656, filed Sept. 14, 1981, now abandoned.

This invention relates generally to drawing aids, in particular to a new type of drawing aid which is versatile, easy to use and whose use is not limited to one particular template pattern.

In the past, single layer, single piece templates have been extensively used as drawing aids for such tasks as lettering, making straight and curved lines, forming shapes such as circles, triangles, rectangles, etc. The commercially available drawing aids are generally designed so that a particular template is used for a particular purpose, e.g., a lettering aid is used only for lettering. In general, the uses of a particular template are limited to the shapes, figures, lines, spacing, etc. formed on the template.

Another limitation of the prior art is for drawing broken lines, such as dotted and/or dashed lines for graphs, graphics, etc. In the past, such lines have been drawn using a ruler, lifting the drawing tool at appropriate intervals; this method of drawing dashed lines is tedious and often results in uneven dashes. Templates have been developed which contain a series of aligned rectangular openings which allow a draftsman to make a line in each opening, thereby forming evenly drawn dashed lines. The disadvantages of such templates are (1) the pattern of dashes and/or dots is limited to the opening sizes available on the template, and (2) the drawing tool must be lifted between dashes and/or dots.

A principal object of this invention is to provide a drawing aid having a sandwich-like structure which comprises a thin, inexpensive, easily manufactured interchangeable insert and a template housing.

A further object of this invention is to provide a drawing aid which is versatile, easy to use and can be used for many drawing tasks.

A still further object of the invention is to provide a drawing aid which can be used to draw broken lines without lifting the drawing tool.

Briefly, in accordance with the invention, a drawing aid is provided which comprises a template housing and an insert which fits into the template housing. The insert is interchangeable with other inserts, each insert having a particular pattern. The interchangeability of the insert enables the drawing of different lines, shapes, letters, etc. using the same template housing. A particularly useful embodiment of the invention comprises a template housing and an insert which allows one to draw a line over the insert pattern to produce broken lines without lifting the drawing tool.

The invention, and objects and features thereof, will be better understood from the following detailed description and appended claims when taken in connection with the accompanying drawings in which:

Figure 1:
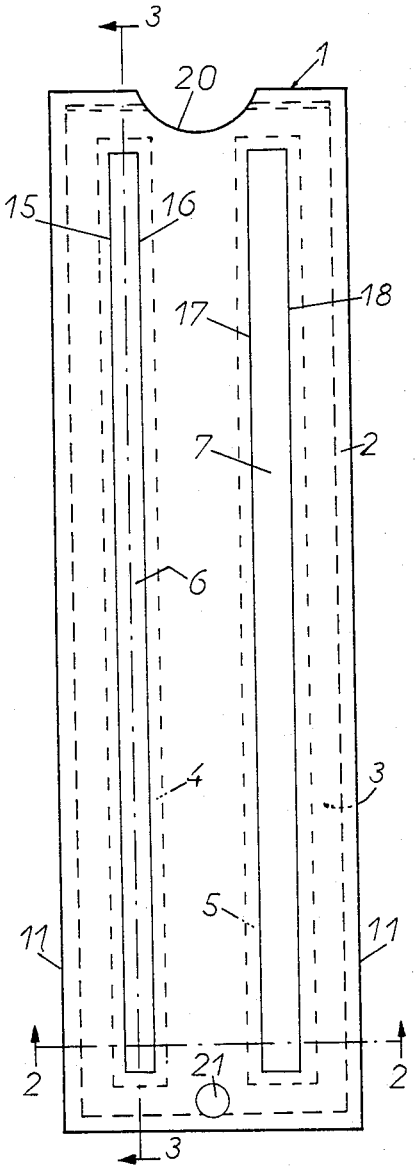
FIG. 1 is a top view of the template housing.
Figure 3:
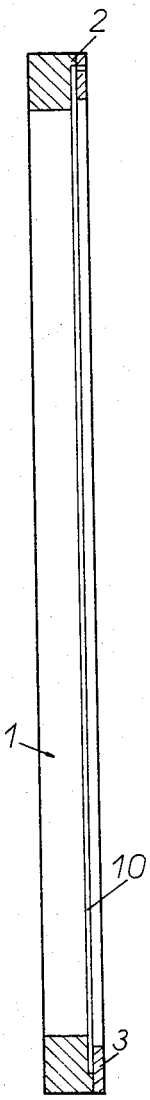
FIGS. 2 and 3 are magnified cross-sectional views of the template housing.
Figure 4:
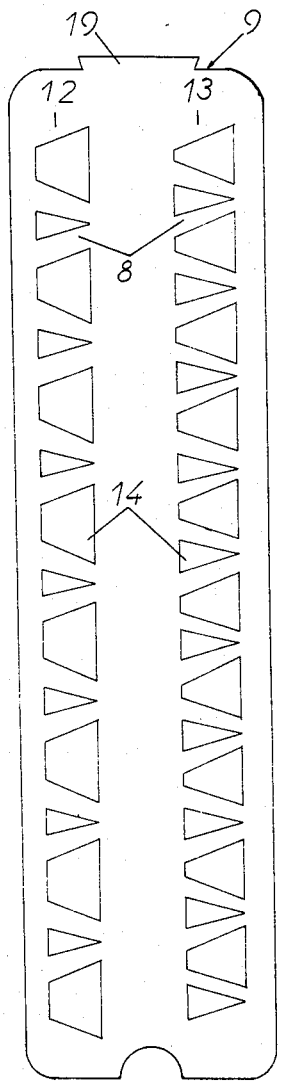
FIG. 4 is a top view of one embodiment of a pattern insert.
Figure 2:
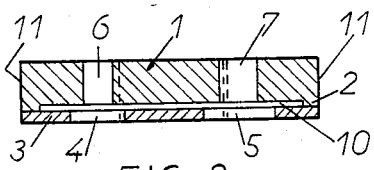

Referring to FIGS. 1 through 5, template housing 1 is a thin, planar piece of plastic, glass, metal, plexiglass, wood or any material suitable for use as a ruler, rigid edge or drawing guide. Template housing 1 can be any size, typically from 5–12″ long, 2–6″ wide, and 0.01–0.15″ thick.

Around the edges of template housing 1 is a raised portion 2, approximately 0.1–1.0 mm above the planar surface of template housing 1, width approximately 1–5 mm. A thin cover sheet 3 of plastic, plexiglass, glass or metal, approximately 0.1–1.5 mm thick, is affixed to three sides of template housing 1 along rim 2 so that a slot 10 is formed between the cover sheet 3 and the template housing 1. Openings 4 and 5 in cover sheet 3 and openings 6 and 7 in template housing 1 are aligned. Preferably, openings 4 and 5 in cover sheet 3 are wider than openings 6 and 7 in order to give more flexibility to the uncarved part 8 of the insert 9 under the pressure of the drawing tool. Slot 10 allows an interchangeable pattern insert to be inserted.

Openings 6 and 7, which are formed in template housing 1 form four straight drawing edges. The width of openings 6 and 7 may be the same as standard lettering guides, e.g. ⅛″ and 3/32″, so that they can also be used as lettering guides. The outside edges 11 of template housing 1 and the edges of openings 6 and 7 may be marked so as to provide a ruler with different scales. The edges of the template housing 1 and of openings 6 and 7 are slightly beveled for better control in drawing. It should be appreciated that the number of openings can be varied but should be at least one. Although each opening may be made to allow two drawing edges, the opening could be very narrow and allow the drawing of one line only.

Pattern insert 9 is a thin sheet of material such as plastic, plexiglass, glass, metal, wood or any other appropriate material. The width and length of pattern insert is such that it will fit into template housing 1 inside slot 10. A pattern 12 and 13 is carved or formed in pattern insert 9 so that when inserted into template housing 1, the patterns 12 and 13 are in alignment with openings 4 and 6, and 5 and 7. By carving out certain pieces 14 of insert 9, different patterns (e.g. 12 and 13) can be obtained. Drawing one straight line along the edges of the openings 6 or 7 over pattern 12 or 13 produces different variations of broken lines (dotted/-dashed lines and combinations thereof). Because of the flexibility of the thin insert 9 over the cover sheet 3, and because the uncarved portions 8 of insert 9 lie against the paper under the pressure of the drawing tool, the probability of tear is minimized. In addition, the uncarved portion 8 of insert 9 moves upward after the drawing tool passes over it and eliminates or minimizes any smearing.

Figure 5:
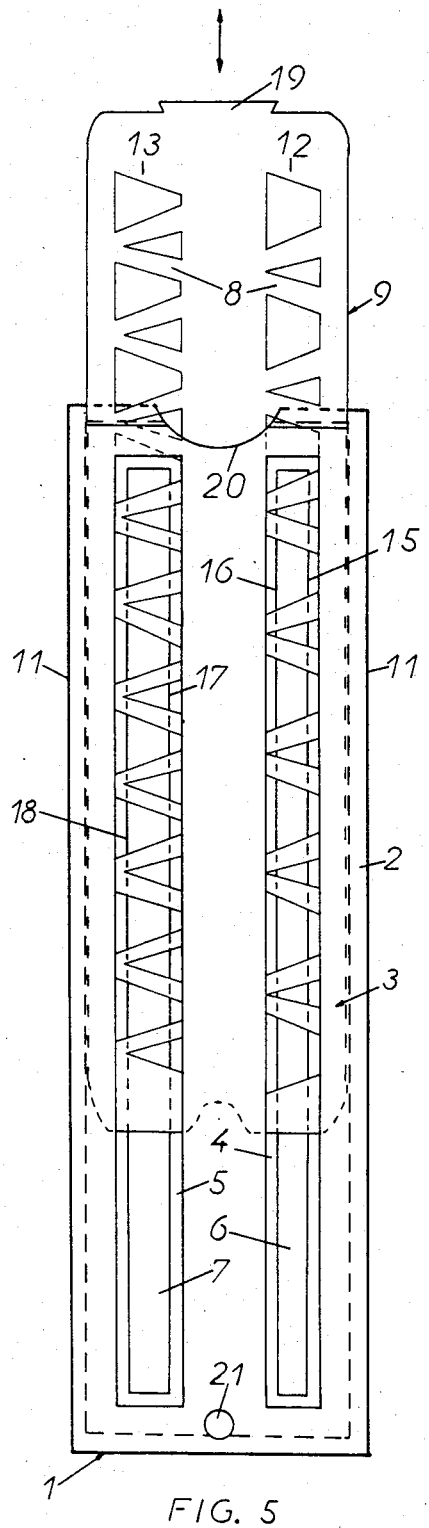
FIG. 5 is a bottom view of one embodiment of the invention which can be used for drawing broken lines.

When the invention is used to draw broken lines, pattern insert 9 is inserted into template housing 1 as shown in FIG. 5. Openings 6 and 4, and 7 and 5 are in alignment with patterns 12 and 13. When the template housing 1 is facing up and the cover sheet is on the paper, a line drawn along edge 15, over pattern 12 will produce a dashed line. A line drawn along edge 16 will produce a different dashed line. Likewise, lines drawn along edges 17 and 18 will also be different broken lines. A different insert 9 with different patterns 12 and 13 may be used to produce a still greater variety of lines.

For convenience, insert-handle 19 on insert 9 and handle-opening 20 in template housing 1 and cover sheet 3 are used for taking insert 9 out of template housing 1. Hole 21 can be used for hanging the drawing aid.

The embodiments of the invention described above are intended to be merely exemplary of the invention.

For example, the template housing is not limited in size or shape; it may be circular, triangular, rectangular or any other shape. The inserts which fit into the template housing may have any pattern or design, and are interchangeable. Those skilled in the art will be able to make modifications and variations without departing from the spirit and scope of the appended claims, all such modifications and variations being contemplated as falling within the scope of the claims.

What is claimed is:

1. A drawing aid for drawing broken lines without lifting a drawing tool comprising:

(a) an interchangeable pattern insert between 0.1–1.0 mm thick comprising regularly spaced triangles; and (b) means for supporting said pattern insert wherein said pattern insert and said supporting means form a three-layer structure such that the bottom layer is thinner than the top layer.

2. A drawing aid for drawing broken lines without lifting a drawing tool as described in claim 1 wherein said regularly spaced triangles alternate with regularly spaced isosceles trapezoids.

3. A drawing aid for drawing broken lines without lifting a a drawing tool as described in claim 1 or 2 wherein said bottom layer is 0.1–1.5 mm thick.

* * * * *